US005941635A

United States Patent [19]

Stewart

[11] Patent Number: 5,941,635

[45] Date of Patent: Aug. 24, 1999

[54] MIXING BLOCK FOR RESUSPENSION SYSTEM

[75] Inventor: Doyle W. Stewart, Hyrum, Utah

[73] Assignee: Hyclone Labortories, Inc., Logan, Utah

[21] Appl. No.: 09/009,287

[22] Filed: Jan. 20, 1998

Related U.S. Application Data

[63] Continuation-in-part of application No. 08/873,095, Jun. 11, 1997.

[51] Int. Cl.[6] ..... B01F 15/02

[52] U.S. Cl. ..... 366/165.5; 366/173.2

[58] Field of Search ..... 366/340, 165.1, 366/165.2, 165.5, 136, 159.1, 173.1, 173.2, 191, 349; 604/408, 416; 206/219; 383/904

[56] References Cited

U.S. PATENT DOCUMENTS

| | | | |
|---|---|---|---|
| 1,035,540 | 8/1912 | Creech | 366/165.2 |
| 1,275,556 | 8/1918 | Hall | 366/165.2 |
| 3,647,397 | 3/1972 | Coleman . | |
| 4,053,142 | 10/1977 | Johannes | 366/165.1 |
| 5,160,333 | 11/1992 | Wells . | |
| 5,257,983 | 11/1993 | Garyantes et al. . | |
| 5,350,080 | 9/1994 | Brown et al. . | |
| 5,362,642 | 11/1994 | Kern . | |
| 5,385,564 | 1/1995 | Slater et al. . | |
| 5,499,871 | 3/1996 | Ulrigh et al. | 366/165.1 |

*Primary Examiner*—Tony G. Soohoo
*Attorney, Agent, or Firm*—Workman, Nydegger & Seeley

[57] ABSTRACT

A resuspension system includes a flexible media bag removably disposed within a rigid support container. The media bag includes an inlet port, an outlet port, and an assembly for mixing and resuspending fluids within the media bag. The assembly for mixing and resuspending includes a peristaltic pump which withdraws fluid from the media bag and introduces the fluid back into the media bag through a mixing block. The mixing block includes a housing having a conical top surface that extends from a hose barb to a circular sidewall. An inlet passageway vertically extends through the hose barb into the housing. A plurality of curved outlet channels extend from the inlet passageway through the circular sidewall of the housing. The outlet channels exit at such an orientation that as fluid passes through the outlet channels, a vortex flow pattern is created within the media bag.

26 Claims, 5 Drawing Sheets

MIXING BLOCK FOR RESUSPENSION SYSTEM

This application is a continuation-in-part of U.S. patent application Ser. No. 08/873,095 filed Jun. 11, 1997 which, for purposes of disclosure, is incorporated herein by specific reference.

BACKGROUND OF THE INVENTION

1. The Field of the Invention

The present invention relates to mixing blocks and, more specifically, mixing blocks used in systems for mixing and suspending sterile and non-sterile fluids.

2. Present State of the Art

In the chemical industry, and in particular the pharmaceutical industry, there is a need for a system capable of holding liquids and mixtures of liquids and solids where a sterile environment can be maintained while providing means for stirring, mixing, resuspending, sampling, and complete delivery of the contents. To date, the industry has relied upon stainless steel storage vessels with associated stirring devices, ports, and mixers. These associated pieces of equipment require special seals in order to assure that the sterile conditions established within the device are maintained during mixing and pumping.

Due to the weight of these stainless steel devices, they are difficult to maneuver, which leads to increased production time. These stainless steel systems often require special handling equipment. When these stainless steel devices are used to transport bulk product, significantly higher shipping costs result due to the weight of the container and the added cost of returning the empty system for future use.

Stainless steel systems are expensive to build and thus impractical for single use disposal. As a result, conventional stainless steel systems must be cleaned and re-sterilized for reuse. This process may involve chemical cleaning with agents such as perchlorate solution, and the attendant disposal problems associated with disposal of such cleaning chemicals. After cleaning, the systems must be inspected and tested to assure that all foreign matter has been removed. Since new products will be introduced, validation of the cleaning and re-sterilization procedures as well as tests to assure efficacy must be completed. This also adds to the costs and complication of using the stainless steel systems.

Since the stainless steel systems are expensive, it is not cost effective to maintain several different sizes of the vessels. As a result, vessel size is usually set to the largest expected batch of material. When small batches are prepared, they are stored in oversized containers with the attendant costs and problems which have been previously described.

One of the primary uses for this type of vessel is the storage and transportation of sterile suspensions of alum in an aqueous medium for use in the production of vaccines. In practice, a sterile alum suspension is prepared in the vessel and shipped to the area where inoculation with the bulk virus or bacteria stock will occur. Since the suspension may be prepared well in advance of inoculation, the system must also serve as a storage container.

Prior to inoculation, the alum must often be resuspended. In many instances, uniform particle size and the preparation of a homogeneous suspension of the alum are critical to the success of the final product. Once resuspension has been assured, the suspension may be pumped into a vessel from which inoculation will occur or inoculation may be carried out from the storage container.

Resuspension of solutions stored in stainless steel systems is often accomplished by shaking the containers using specialized equipment such as paint shaking type devices. Such equipment is often unaccessible, especially in remote areas, and can be very inconvenient, particularly for large containers. In the alternative, the solution can be cycled into and out of the container until the solution becomes homogeneous. This cycling process, however, takes a relatively long time and, depending on the size of the container and type of solution, cannot guarantee that the solution is homogeneous throughout the container.

OBJECTS AND BRIEF SUMMARY OF THE INVENTION

It is therefore an object of the present invention to provide apparatus for transporting, storing, and resuspending solutions in a sterile environment.

It is another object of the present invention to provide apparatus as above which are disposable.

Yet another object of the present invention is to provide apparatus as above which can quickly and effectively resuspend a solution to a uniform homogeneous state.

Furthermore, since the uniformity of a resuspension is often important to the uniformity of a final vaccine product, it is another object of the present invention to provide apparatus which enable dispensing of product with no apparent settling.

In addition, it is an object to provide apparatus that deliver as much of the suspension as possible so that only a minimal amount of material is retained within the system once dispensing is complete.

Finally, another object of the present invention is to provide apparatus as above which do not interact with the product. That is, the apparatus should not absorb protein, adjuvants, or other ingredients from the resuspension.

To achieve the foregoing objects, and in accordance with the invention as embodied and broadly described herein, a lightweight, sterilizable system capable of mixing, storing, resuspending, shipping and dispensing solutions or suspensions is provided. The system includes a flexible media bag removably disposed within a rigid support container such as a barrel. The support container has a substantially frustoconical floor on which the media bag rests. The media bag has an inlet for delivering fluids into the media bag and an outlet for withdrawing fluids from the media bag.

Coupled to the media bag is a mixing system. The mixing system includes a peristaltic pump positioned outside of the media bag. A first tubing assembly extends from the media bag to the first end of the peristaltic pump for withdrawing fluid from the media bag. A second tubing assembly extends from the opposing end of the peristaltic pump to the interior of the media bag. A mixing block is fluid coupled to the end of the second tubing assembly disposed within the media bag. The fluid thus flows from the peristaltic pump through the second tubing assembly and mixing block and back into the media bag.

The mixing block sits on the floor of the support container and comprises a housing having a conical top surface. The top surface extends from a hose barb to a circular sidewall. An inlet passageway vertically extends through the hose barb into the housing. A plurality of curved outlet channels extend from the inlet passageway through the circular sidewall of the housing. The outlet channels exit the housing at such an orientation that fluid flowing therethrough produces a vortex flow in the fluid within the media bag, thereby mixing or resuspending the solution.

The mixing block effects a rapid mixing and resuspension of the fluid, is easily and inexpensively manufactured, and precludes the necessity of having to shake the container or media bag. These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
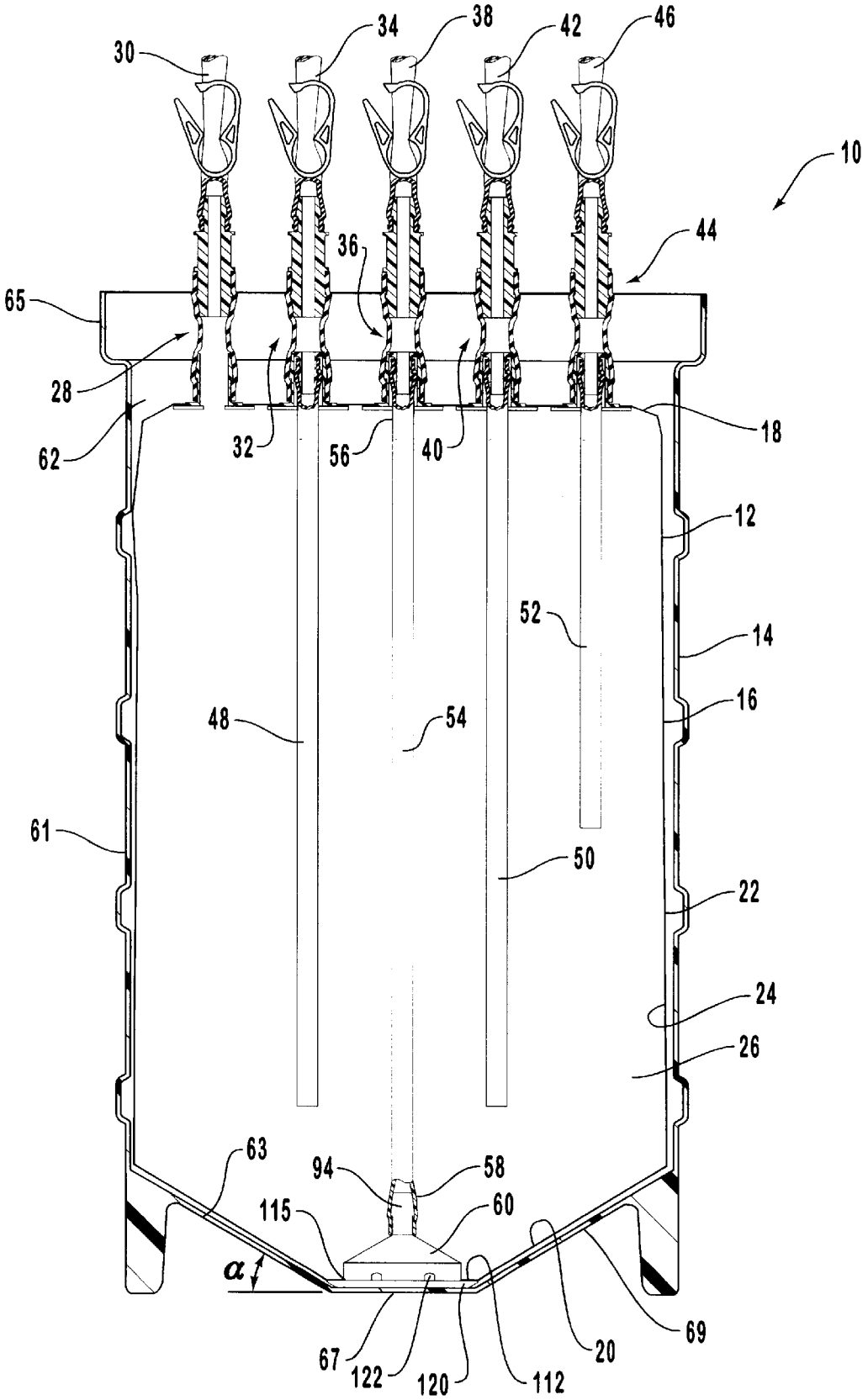
FIG. 1 is a cross sectional front view of one embodiment of a resuspension system including a collapsible media bag and a support container.

Depicted in FIG. 1 is one embodiment of a resuspension system 10 incorporating features of the present invention. Resuspension system 10 includes a collapsible media bag 12 disposed within a rigid support container 14. Media bag 12 comprises a body wall 16 having a top end 18, a bottom end 20, an exterior surface 22, and an interior surface 24. Interior surface 24 bounds a chamber 26 enclosed within media bag 12.

Mounted to top end 18 of media bag 12 are a plurality of port assemblies. The port assemblies include a first port assembly 28 which is used to fluid couple a supply tube 30 to media bag 12. A second port assembly 32 is used to fluid couple a delivery tube 34 to media bag 12. A third port assembly 36 is used to fluid couple a return tube 38 to media bag 12. A fourth port assembly 40 is used to fluid couple a first outlet tube 42 to media bag 12. Finally, a fifth port assembly 44 is used to fluid couple a second outlet tube 46 to media bag 12. One embodiment of port assemblies 28,32,36,40, and 44 is disclosed in U.S. Pat. No. 08/975,767 filed Nov. 21, 1997 which is incorporated herein by specific reference.

Media bag 12 may be fabricated from any suitable material that will function within desired temperature ranges for a given fluid substance and will not adversely interact with the fluid substance. Fluid substances can include chemicals fluids, pharmaceutical fluids, biological fluids, and others. Since one of the primary functions of media bag 12 is for use in the preparation of alum based vaccines, media bag 12 can be designed to withstand sterilization using Gamma irradiation or other suitable techniques which are known in the art.

In one embodiment of the invention, media bag 12 is initially evacuated of air before being treated with Gamma radiation. Media bag 12 may then be shipped in its most compact state and stored in this manner until needed. When a liquid is added to media bag 12, media bag 12 expands as needed in response to the added volume of fluid. As a result of this feature, the head space, or air volume, within media bag 12 is held to a minimum.

Body wall 16 of media bag 12 can be made of any thin, flexible plastic meeting the above requirements. By way of example and not by limitation, a polymeric material, such as linear low density polyethylene, can be used to produce media bag 12. Linear low density polyethylene meets the requirements set forth above in that it will not interact with aqueous solutions or suspensions, does not absorb the media or inoculum used to produce a vaccine, and is useful between about 1° C. to about 60° C. Other polymeric materials which meet the requirements of a desired fluid contact substance may also be used to construct media bag 12.

Body wall 16 can comprise a single layer of material or, more preferably, a plurality of layers or liners. The multiple layers limit the potential of a leak which could contaminate fluids held within media bag 12. In one embodiment of media bag 12, body wall 16 comprises three layers. The inner most layers comprise blown film polyethylene and the outer layer is a co-extruded EVOH nylon.

Disposed within chamber 26 of media bag 12 are a plurality of dip tubes. A first dip tube 48 is coupled to second port assembly 32. A second dip tube 50 is coupled to fourth port assembly 40. A third dip tube 52 having a length shorter than second dip tube 50 is coupled to fifth port assembly 44. A tube 54 has a first end 56 coupled to third port assembly 36 and an opposing second end 58 fluid coupled to a mixing block 60. Mixing block 60 will be discussed later in greater detail.

Support container 14 is a self-supporting structure, such as a barrel, having an internal chamber 62 in which media bag 12 can be selectively positioned. In the embodiment depicted, support container 14 has a substantially cylindrical sidewall 61 extending from a floor 63 to an open top end 65. Top end 65 can be closed by a lid. Floor 63 has a substantially frustoconical configuration. Specifically, floor 63 has a circular flat rest 67 with an annular wall 69 radially sloping up from rest 67 to sidewall 61. Wall 69 slopes at an outside angle $\alpha$ in a range between about 10° to about 50° with about 20° to about 40° being preferred, and about 25° to about 35° being more preferred the function of sloped wall 69 will be discussed later in greater detail.

Support container 14 functions in part to protect media bag 12 from outside elements and to support media bag 12. Support container 14 thus enables safe long distance transport of media bag 12. In one embodiment, support container 14 can be made of materials such as plastics, composites, metal, fiberglass, or other synthetic materials. Materials that are inexpensive and disposable are preferred.

Figure 2:
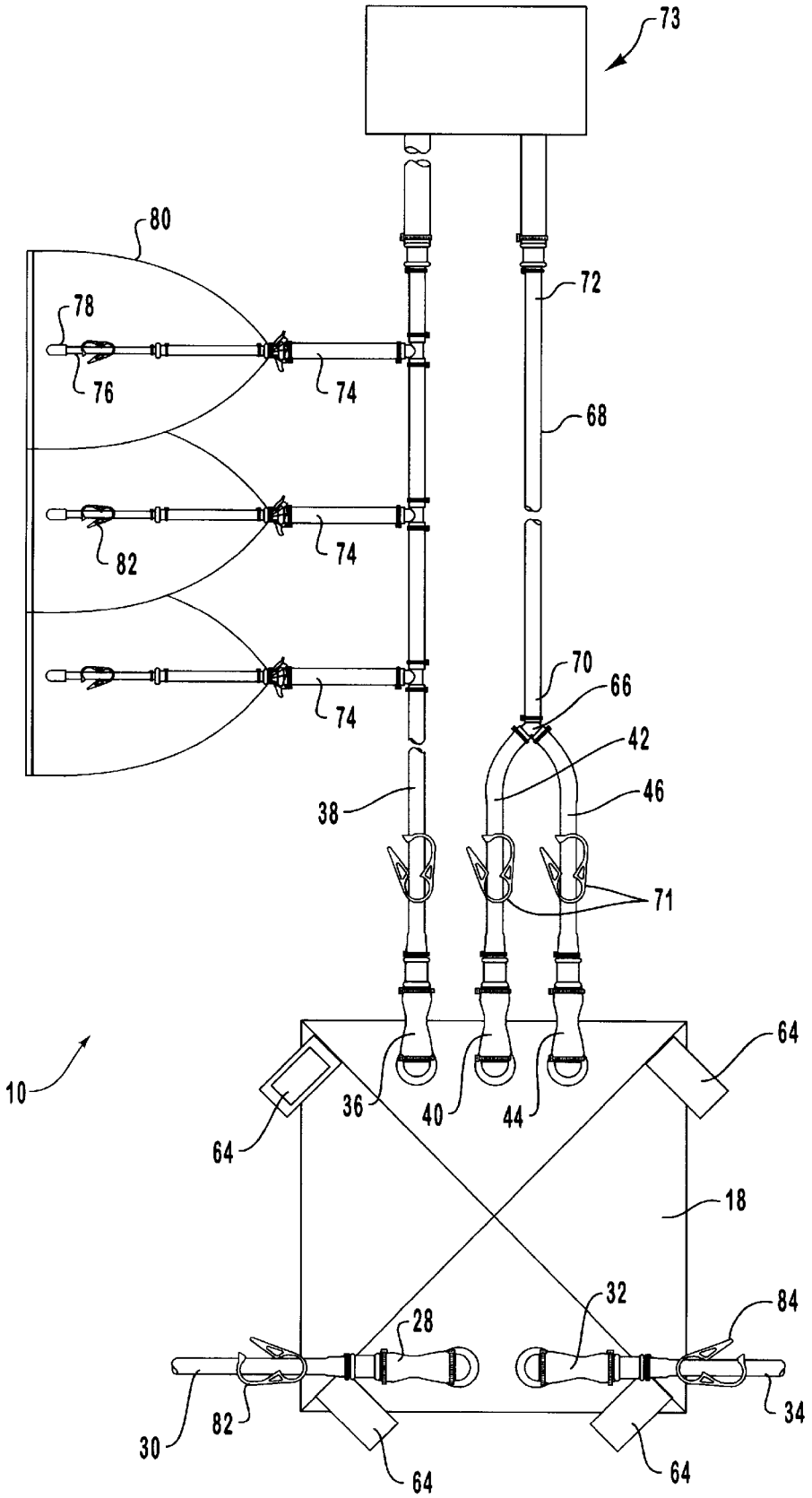
FIG. 2 is a schematic diagram of a pump coupled with the collapsible media bag of FIG. 1.

Depicted in FIG. 2, mounted to top end 18 of media bag 12 are a plurality of loop handles 64. Loop handles 64 can be selectively attached to the interior of support container 14 for securing and supporting media bag 12 within support container 14.

As also depicted in FIG. 2, resuspension system 10 further includes a "Y" adapter 66 fluid coupling first outlet tube 42 and second outlet tube 46. A transition tube 68 has a first end 70 also fluid coupled to "Y" adapter 66 and an opposing second end 72 fluid coupled to a peristaltic pump 73. Return tube 38 extends from the opposing end of peristaltic pump 73 to third port assembly 36. In this way, a loop is formed for withdrawing fluid from media bag 12 and returning it to media bag 12.

For example, during operation of peristaltic pump 73, fluid is drawn from chamber 26 into either dip tube 50 and first outlet tube 42 or dip tube 52 and second outlet tube 46. The selection of which tubes the fluid flows is made by closing off one of outlet tubes 42 and 46 using hose clamps 71 mounted thereon. Next, the fluid travels down transition tube 68, through peristaltic pump 73, and back to media bag 12 through return tube 38. Finally, the fluid passes through tube 54 and mixing block 60 where it enters back into chamber 26. In alternative embodiments, other types of pumps can be used as long as they do not adversely interact with the fluid substance.

A plurality of testing tubes 74 extend from return tube 38 to a free end 76. To help maintain sterility of the system, testing tubes 74 are initially manufactured having a removable cap 78 and a sealing bag 80 positioned over free end 76. Once sealing bag 80 and cap 78 are removed, hose clamps 82 function as valves to effect opening and closing of testings tubes 74. Testing tubes 74 are used for withdrawing test samples of the fluid passing through return tube 38. Such samples can be used to determine if the fluid is sufficiently mixed or resuspended. By selectively drawing fluid from dip tube 50 or 52, the fluid within media bag 12 can be tested at different elevations within media bag 12, thereby insuring that the fluid is homogeneous.

Supply tube 30 interacts with first port assembly 28 to delivery fluid into chamber 26 of media bag 12. The fluid can include liquids, suspensions, and mixtures of liquids and solids. The fluid is withdrawn from media bag 12 for use through first dip tube 48 and delivery tube 34. The chemical integrity and sterility of media bag 12 is assured through the incorporation of valve means such as hose clamp 82 mounted on supply tube 30 and hose clamp 84 mounted on delivery tube 34. Since media bag 12 is initially evacuated before use, when clamp 82 of supply tube 30 is opened and fluid flows in, media bag 12 expands and takes the shape of support container 14 or if support container 14 is not present, media bag 12 expands to the limits of its own shape.

Figure 3:
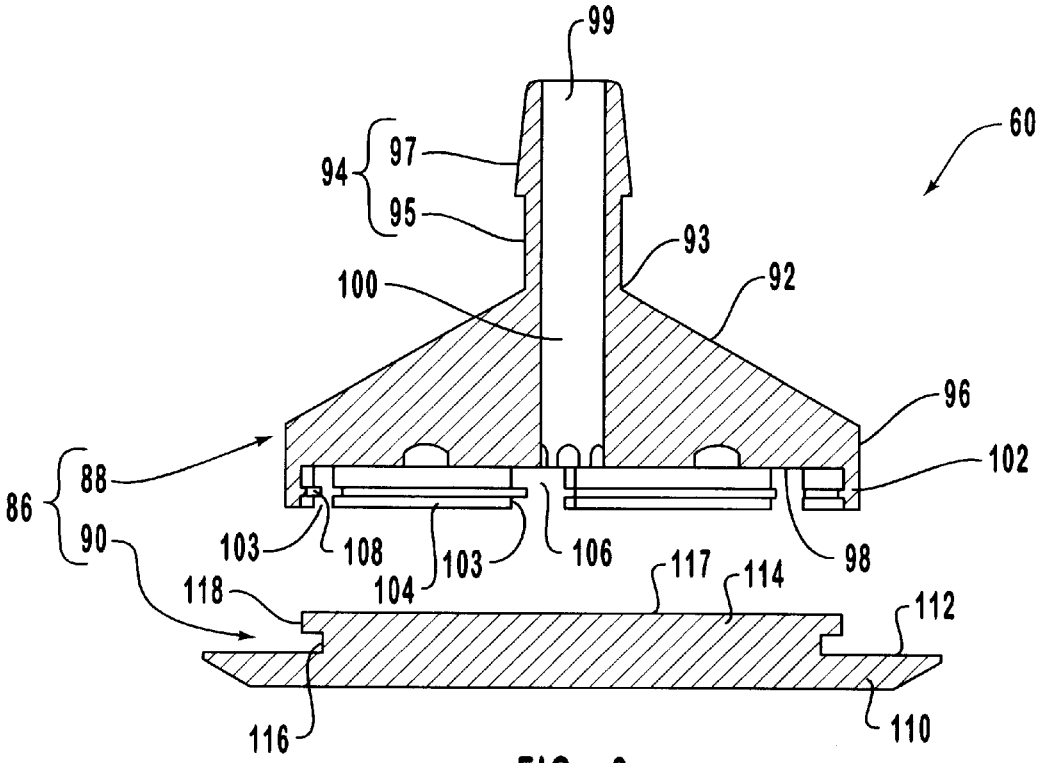
FIG. 3 is a cross sectional side view of a mixing block shown in FIG. 1 in a disassembled condition.

In one embodiment of the present invention, means are provided for mixing and resuspending the fluid within chamber 26 of media bag 12. By way of example and not by limitation, one embodiment of the means includes mixing block 60 interacting with peristaltic pump 73 and the tubing associated therewith. As depicted in FIG. 3, mixing block 60 comprises a housing 86 which includes a cap 88 and a base 90. Cap 88 includes a conical top surface 92 which extends from a top end 93 to a circular sidewall 96. Cap 88 further includes a substantially flat bottom surface 98 that likewise extends to sidewall 96. An inlet passageway 100 having a substantially circular transverse cross section vertically extends from top end 93 through bottom surface 98.

The present invention also includes means for fluid coupling tube 54 to mixing block 60. By way of example and not by limitation, a hose barb 94 is mounted to top end 93 of cap 88. Hose barb 94 includes a hollow stem 95 upwardly projecting from top end 93 and an annular barb 97 radially projecting out from the free end of stem 95. An opening 99 extends through stem 95 and is concentrically aligned with inlet passageway 100. As depicted in FIG. 1, hose barb 94 is configured to be snugly received within second end 58 to tube 54 so as to effect a fluid tight seal therebetween. Of course there are a variety of alternative coupling devices that can be used for fluid coupling tube 54 to mixing block 60. For example, the elements could be screwed together or bonded together such as by an adhesive or welding.

In one embodiment of the present invention, means are provided for mechanically coupling cap 88 to base 90. By way of example and not by limitation, as depicted in FIG. 3, vertically projecting down from base 98 adjacent to sidewall 96 is an annular retention wall 102 having a plurality of slots 103 extending therethrough. Retention wall 102 has an interior surface 104 that partially bounds a shallow recess 106. Projecting into recess 106 from interior surface 104 is a ridge 108.

Figure 4:
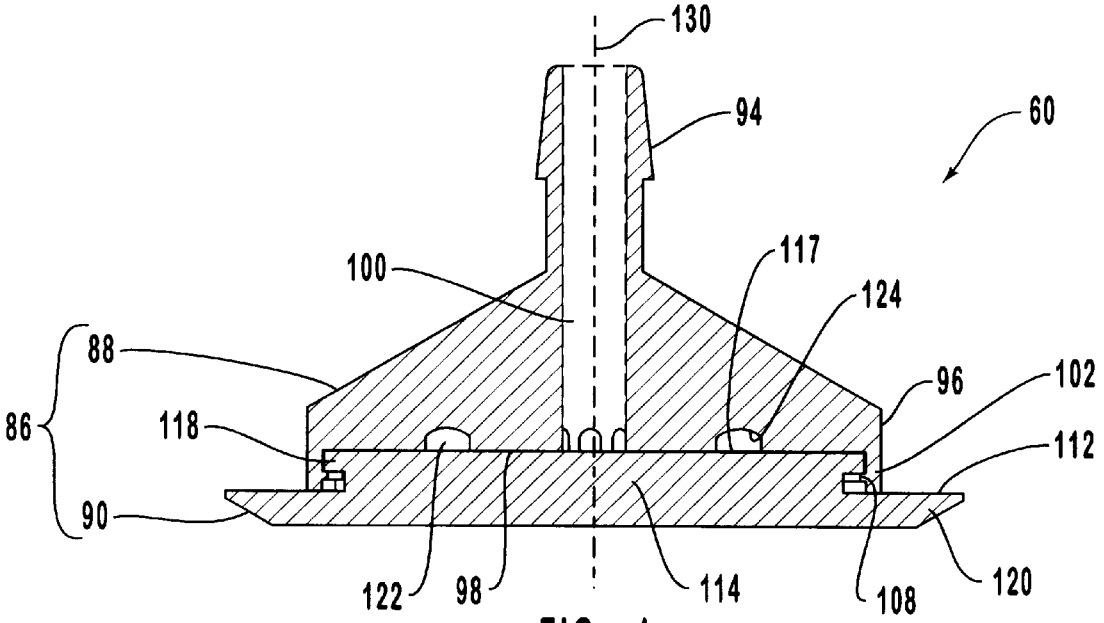
FIG. 4 is a cross sectional side view of the mixing block shown in FIG. 3 in an assembled condition.

Base 90 comprises a circular platform 110 having a plate-like configuration with a flat top surface 112. Projecting from top surface 112 is a disk shaped plug 114. Plug 114 has an annular sidewall 116 and a flat top surface 117. Radially projecting out from sidewall 116 at a distance from top surface 112 of platform 110 is a lip 118. Cap 88 and base 90 are configured such that as plug 114 is advanced into recess 106 of cap 88, retention wall 102 radially expands out such that lip 118 interlocks behind ridge 108 so as to mechanically secure cap 88 to base 90, as depicted in FIG. 4.

The present invention also envisions that there are a plurality of alternative ways in which cap 88 and base 90 can be mechanically coupled together. For example, the structures can be screwed together or a variety of conventional latching mechanisms can be used for attaching the structures. In yet other embodiments, a variety of different plug and socket structures can be used. Although not mechanical, the present invention also envisions that the elements can be secured together either by an adhesive or by welding.

The present invention also includes means for securing mixing block 60 to media bag 12. By way of example and not by limitation, as depicted in FIG. 4, when base 90 is secured to cap 88, platform 110 includes an outer edge portion 120 that radially projects out past sidewall 96 of cap 88. During attachment to media bag 12, as depicted in FIG. 1, an aperture 115 is initially formed through bottom end 20 of media bag 12. Aperture 115 has an inside diameter substantially complementary to the outside diameter of sidewall 96 of cap 88. During assembly, cap 88 is advanced through aperture 115 until exterior surface 22 of media bag 12 is biased against top surface 112 of edge portion 120. Thermal welding can then be used to secure media bag 12 to edge portion 120, thereby affecting a liquid tight seal therebetween. The process of thermal welding can be accomplished by using a Vertrod Heat Sealing Machine or other suitable device. Alternatively, acceptable adhesives can also be used. In this design, a portion of mixing block 60 is exposed to the exterior of media bag 12. By using this assembly process, mixing block 60 can be attached after the manufacture of media bag 12 is complete.

Figure 5:
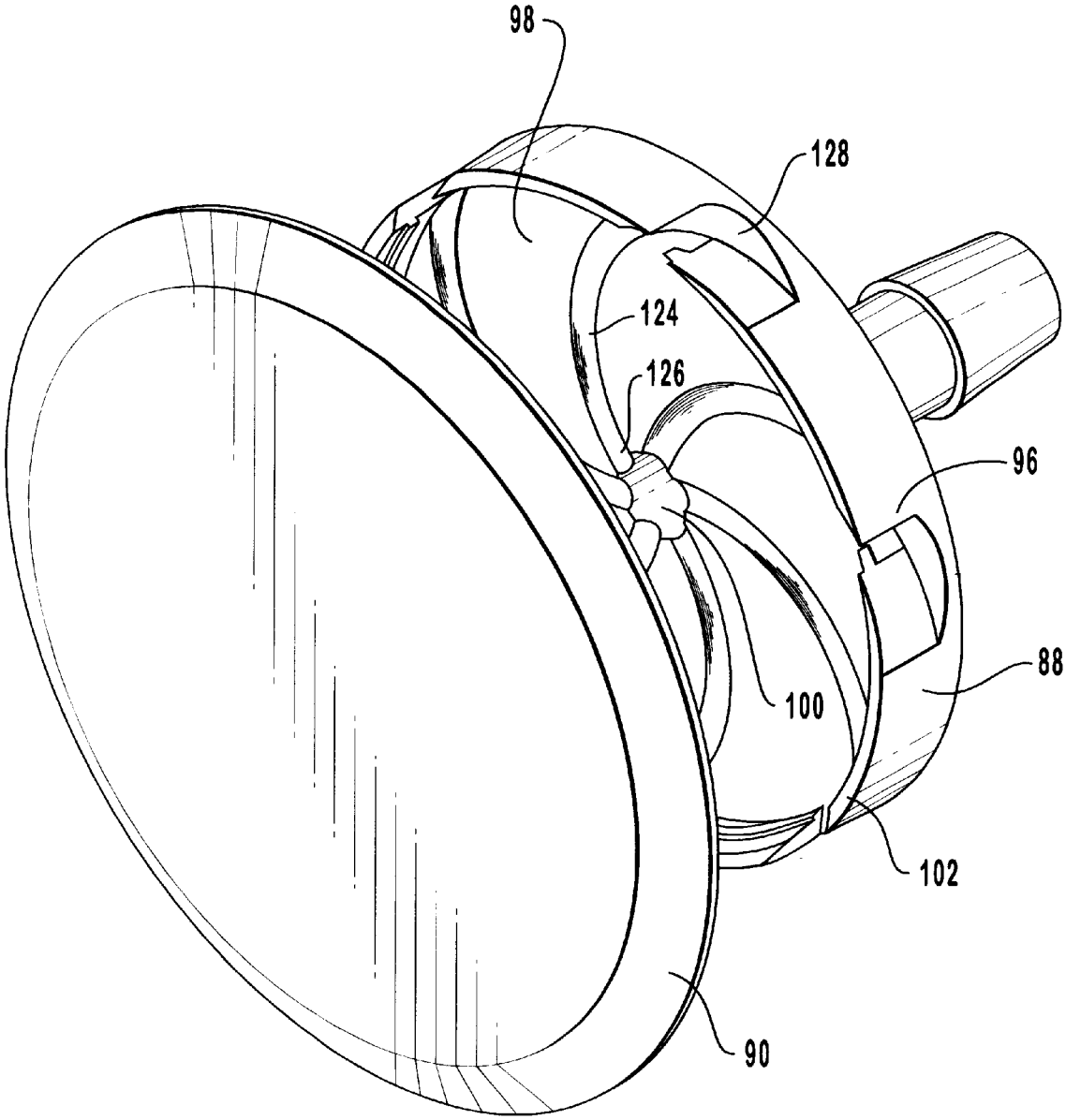
FIG. 5 is a perspective view of the mixing block shown in FIG. 1 in a disassembled condition.

Mixing block 60 further includes a plurality of outlet channels 122 extending from inlet passageway 100 to sidewall 96 of cap 88. As depicted in FIGS. 4 and 5, outlet channels 122 are comprised of a plurality of outlet grooves 124 recessed within bottom surface 98 of cap 88. Each outlet groove 124 has a first end 126 that communicates with inlet passageway 100 and an opposing second end 120 that exits through sidewall 96 of cap 88. Top surface 117 of base 90 biases against bottom surface 98 of cap 88 to enclose outlet grooves 124, thereby forming outlet channels 122 that are substantially sealed closed along their length. In alternative embodiments, outlet grooves 124 can be recess within base 90 or complementary outlet grooves can be formed in both base 90 and cap 88.

Figure 6:
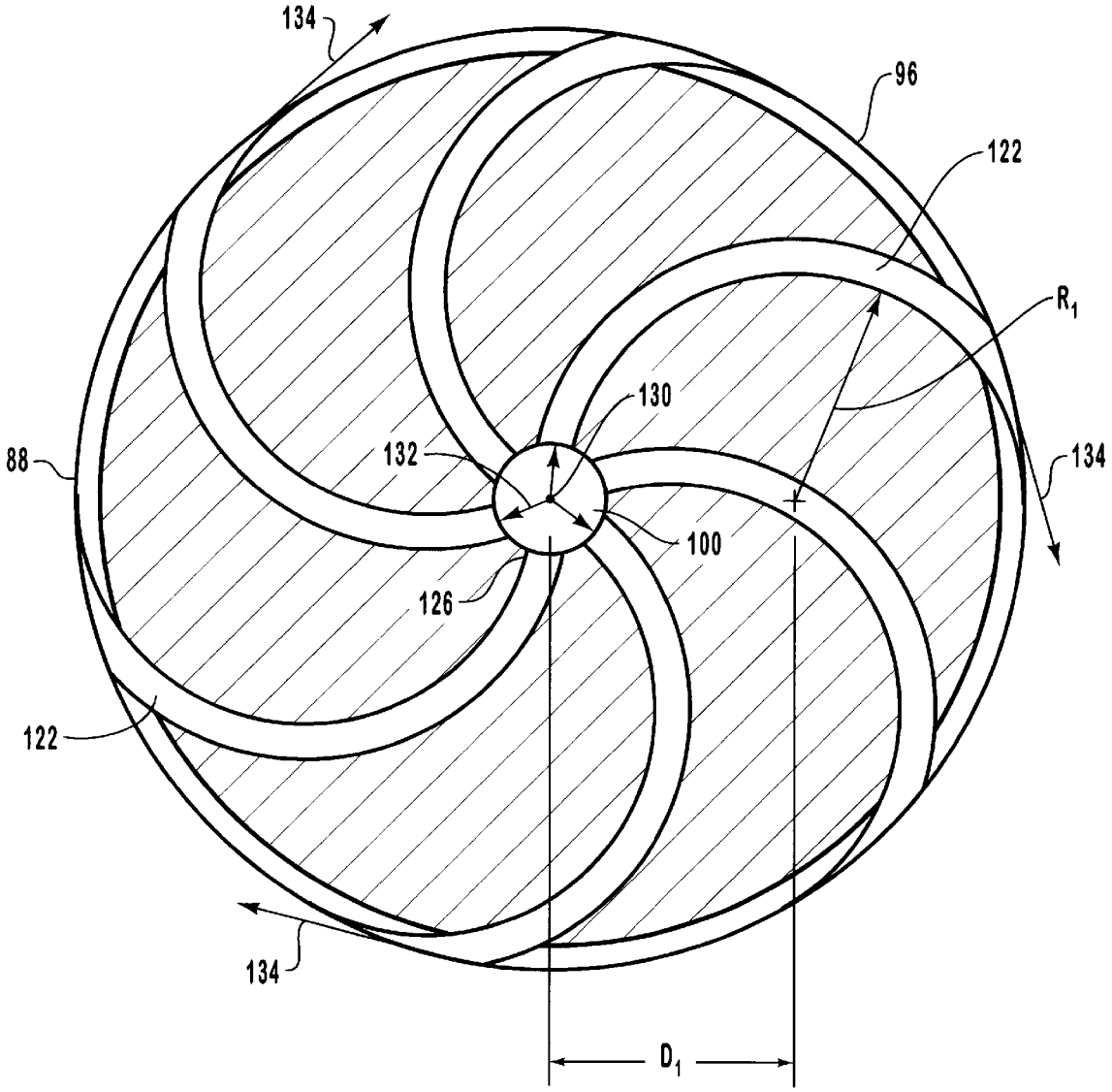
FIG. 6 is a bottom plan view of the cap of the mixing block shown in FIG. 5.

Initially, fluid traveling within inlet passageway 100 travels in a path parallel to the longitudinal axis 130 of inlet passageway 100. Base 90, however, seals closed the adjacent end of inlet passageway 100. As a result, the fluid is forced to deflect at a 90° angle and travel into outlet channels 122. This deflection of the fluid, increases the turbulent flow of the fluid, thereby improving mixing. As depicted in FIG. 6, each first end 126 of outlet channels 122 is radially aligned with longitudinal axis 130 of inlet passageway 100. As a result, the fluid flows radially out from inlet passageway 100 into outlet channels 122 as depicted by arrows 132.

Each of outlet channels 122, however, are curved such that fluid exiting sidewalls 96 does so at an angle substantially tangential to sidewall 96, as depicted by arrows 134. As a result of sidewall 96 being at least substantially circular, the tangential flow of the fluid out of mixing block 60 produces a vortex flow pattern within media bag 12. Although it is not necessary that the fluid exit at an angle exactly tangential to the exterior surface, the fluid should exit at an angle sufficient to create the vortex flow pattern. It is this vortex flow pattern which effects mixing and resuspension of solids within the fluid, thereby producing a homogenous solution throughout chamber 26.

The configuration of floor 63 of support container 14 can assist in producing the desired vortex flow pattern. As depicted in FIG. 1, when media bag 12 is disposed within support container 14, mixing block 60 is disposed on rest 67 while bottom end 18 of media bag 12 sits against sloped wall 69. As a result, bottom end 18 of media bag 12 maintains the complementary configuration of sloped wall 69. In this configuration, outlet channels 122 exit mixing block 60 at a low point within media bag 12, thereby helping to insure that there is no stagnate pooling within media bag 12. Furthermore, by slopping bottom end 18 of media bag 12, fluid exiting outlet channels 122 is forced upward, thereby helping to effect the desired vortex flow. The present invention envisions that floor 63 can have other configurations such as hemispherical, spiral, or other conical configurations.

To help optimize pump and mixing efficiencies, in one embodiment outlet channels 122 curve in a circular path that minimizes the distance each outlet channel 122 travels in changing from radial alignment with inlet passage 100 to a tangential alignment with sidewall 96. By way of example, each outlet channel 122 can have a radius $R_1$ of about 0.975 inches based on an offset $D_1$ of about 0.975 inches, as depicted in FIG. 6. In alternative embodiments, outlet channels 122 can be disposed in an elliptical path or any other conical configuration. Likewise, rather than having a smooth transition, outlet channels 122 can also be formed in linear sections with abrupt corners.

To further optimize the efficiency of the system, in one embodiment the transverse cross-sectional area of inlet passageway 100 is in a range between about the summation of the transverse cross-sectional areas of outlet channels 122 and 1.05 times the summation of the transverse cross-sectional areas of outlet channels 122, more preferably, the range is between about the summation of the transverse cross-sectional areas of outlet channels 122 and 1.1 times the summation of the transverse cross-sectional areas of outlet channels 122. By way of example, in one embodiment inlet passageway 100 has a transverse cross-sectional area of about 0.126 square inches while each outlet channel 122 has a transverse cross-sectional area of about 0.022 square inches.

Mixing block 60 can be fabricated from a variety of different plastics such as low or high density polyethylene. Other types of materials can also be used so long as they will operate under desired operating conditions and will not adversely interact with the contained fluid. In order to be practical in an environment using sterile vaccines, in one embodiment the system is capable of resuspending alum in a time period less than 2 hours, preferably less than about 1 hour, and more preferably less than about 30 minutes.

It is envisioned that there are a variety of alternative ways in which mixing block 60 can be constructed. For example, rather than having two parts that are machined and then secured together, mixing block 60 can be molded as an integral unit. In yet other embodiments, it is not necessary that outlet channels 122 intersect with inlet passageway 100 at a right angle. In alternative embodiments, outlet channels 122 can intersect with inlet passageway 100 at any three dimensional angle and can then subsequently curve in three dimensions before exiting mixing block 60.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A mixing block operable with fluid, the mixing block comprising a housing having an exterior surface, the housing bounding an inlet passageway communicating with the exterior and a plurality of curved outlet channels extending from the inlet passageway to the exterior, the plurality of outlet channels being configured such that the fluid flowing from the inlet passageway through the outlet channels exits the housing at an angle substantially tangential to the exterior surface of the housing.

2. A mixing block as recited in claim 1, wherein the inlet passageway and the plurality of outlet channels are configured such that the fluid flows from the inlet passageway into the outlet channels at an angle substantially perpendicular to the fluid flow exiting the housing.

3. A mixing block as recited in claim 1, wherein each of the curves of the outlet channels are at a constant radius.

4. A mixing block as recited in claim 1, wherein the inlet passageway has a transverse cross sectional area and each outlet channel has a transverse cross sectional area, the transverse cross sectional area of the inlet passageway being in a range between about the summation of the transverse cross sectional areas of the outlet channels and about 1.05 times the summation of the transverse cross sectional areas of the outlet channels.

5. A mixing block as recited in claim 1, wherein the inlet passageway and at least one of the outlet channels intersect at a right angle.

6. A mixing block operable with a tube, the mixing block comprising a housing having a top surface extending to a substantially circular sidewall, the housing bounding:

(a) an inlet passageway extending from the top surface into the housing; and (b) a plurality of curved outlet channels extending from the inlet passageway to the sidewall.

7. A mixing block as recited in claim 6, wherein the inlet passageway extends substantially vertically into the housing and the plurality of curved outlet channels are disposed in a substantially horizontal plane.

8. A mixing block as recited in claim 6, further comprising means for fluid coupling the tube to the inlet passageway.

9. A mixing block as recited in claim 8, wherein the means for coupling comprises a hose barb projecting from the housing in alignment with the inlet passageway.

10. A mixing block as recited in claim 6, wherein the inlet passageway and at least one of the outlet channels intersect at a right angle.

11. A mixing block as recited in claim 6, wherein the top surface of the housing is substantially conical.

12. A mixing block as recited in claim 6, wherein the plurality of outlet channels comprises at least four outlet channels.

13. A mixing block operable with a fluid, the mixing block comprising:

(a) a cap having a top surface, a bottom surface, and an inlet passageway extending therebetween; and (b) a base having a top surface, the top surface of the base and the bottom surface of the cap being configured such that when the top surface of the base and the bottom surface of the cap are coupled together a plurality of curved outlet passageways are formed that extend from the inlet passageway to the exterior.

14. A mixing block as recited in claim 13, wherein the cap comprises a plurality of curved grooves recessed within the bottom surface and extending from the inlet passageway to the exterior, the grooves forming the channels when the cap is coupled with the base.

15. A mixing block as recited in claim 13, further comprising means for mechanically coupling the cap and base together.

16. A mixing block as recited in claim 15, wherein the means for mechanically coupling comprises:

(a) a retention wall projecting down from the bottom surface of the cap, the retention wall having an inside surface bounding a recess and having a ridge inwardly projecting therefrom; and (b) the base having a sidewall with a lip projecting therefrom, the cap and base being configured such that the ridge and lip mechanically interlock when the base is biased against the cap.

17. A mixing block as recited in claim 13, wherein the inlet passageway extends substantially vertically into the housing and the plurality of curved outlet channels are disposed in a substantially horizontal plane.

18. A mixing block as recited in claim 13, wherein the curve of the outlet channels is constant.

19. A fluid suspension system operable with a fluid, the system comprising:

(a) a collapsible fluid media bag bounding a chamber that is configured to hold the fluid, the media bag having an inlet and an outlet formed thereon;

(b) a mixing block having an exterior at least partially disposed within the chamber of the media bag, the mixing block bounding:

(i) an inlet passageway having a first end exposed to the chamber and an opposing second end disposed within the mixing block; and (ii) a plurality of outlet channels extending from the second end of the inlet passageway to the exterior surface of the mixing block disposed within the chamber, the outlet channels exiting the mixing block at such an orientation that fluid passing therethrough produces a circular flow pattern in the fluid within the media bag; and (c) a tube extending from the inlet of the media bag to the first end of the mixing block.

20. A fluid suspension system as recited in claim 19, further comprising means for securing the mixing block to the media bag such that a portion of the media bag is positioned outside of the media bag.

21. A fluid suspension system as recited in claim 19, wherein the means for securing comprises:

(a) an aperture formed through the media bag; and (b) an edge portion radially projecting out from the mixing block, the edge portion being configured to bias against the media bag when mixing block is positioned within the aperture of the media bag.

22. A fluid suspension system as recited in claim 19, wherein at least one of the outlet channels is curved.

23. A fluid suspension system as recited in claim 19, wherein the mixing block has a substantially circular sidewall through which at least one of the outlet channels exits.

24. A fluid suspension system as recited in claim 23, wherein the at least one of the outlet channels exits at an orientation substantially tangential to the sidewall.

25. A fluid suspension system as recited in claim 19, wherein the inlet passageway and at least one of the outlet channels intersect at a right angle.

26. A mixing block operable with fluid, the mixing block comprising a housing having an exterior surface, the housing bounding an inlet passageway communicating with the exterior and a plurality of outlet channels extending from the inlet passageway to the exterior, the plurality of outlet channels being configured such that the fluid flowing from the inlet passageway through the outlet channels exits the housing at an angle substantially tangential to the exterior surface of the housing, the inlet passageway having a transverse cross sectional area and each outlet channel having a transverse cross sectional area, the transverse cross sectional area of the inlet passageway being in a range between about the summation of the transverse cross sectional areas of the outlet channels and about 1.05 times the summation of the transverse cross sectional areas of the outlet channels.

* * * * *

UNITED STATES PATENT AND TRADEMARK OFFICE

CERTIFICATE OF CORRECTION

PATENT NO. : 5,941,635

DATED : Aug. 24, 1999

INVENTOR(S) : Doyle W. Stewart

It is certified that error appears in the above-identified patent and that said Letters Patent is hereby corrected as shown below:

Col. 3, line 58, change "28,32,36,40" to --28, 32, 36, 40--

Col. 4, line 51, after "more" change "preferred the" to --preferred. The--

Col. 7, line 1, after "be" change "recess" to --recessed--

Col. 7, line 30, after "end" change "18" to --20--

Col. 7, line 31, afer "end" change "18" to --20--

Col. 7, line 36, after "by" change "slopping" to --sloping--

Col. 7, line 36, after "end" change "18" to --20--

Signed and Sealed this

Twenty-fifth Day of July, 2000

*Attest:*

*Attesting Officer*

Q. TODD DICKINSON

*Director of Patents and Trademarks*